US006478072B1

(12) United States Patent
Allman

(10) Patent No.: US 6,478,072 B1
(45) Date of Patent: Nov. 12, 2002

(54) SOLAR SCREEN MOUNTING FOR AN AWNING WINDOW

(76) Inventor: Raymond L. Allman, 706 N. Madison, Fowler, IN (US) 47944

( * ) Notice: Subject to any disclaimer, the term of this patent is extended or adjusted under 35 U.S.C. 154(b) by 0 days.

(21) Appl. No.: 09/886,586

(22) Filed: Jun. 21, 2001

(51) Int. Cl.[7] ..... A47H 1/00
(52) U.S. Cl. ..... 160/89; 49/62
(58) Field of Search ..... 160/96, 97, 89; 49/463, 464, 62, 63, 64, 70

(56) References Cited

U.S. PATENT DOCUMENTS

| | | | | |
|---|---|---|---|---|
| 21,417 | A | | 9/1858 | Herder |
| 97,916 | A | | 12/1869 | Hebron |
| 2,124,240 | A | | 7/1938 | Thorp |
| 2,231,573 | A | | 2/1941 | Etling |
| 2,755,524 | A | | 7/1956 | Honer |
| 2,867,861 | A | * | 1/1959 | Pilson |
| 2,879,841 | A | * | 3/1959 | Etten |
| 3,014,252 | A | | 12/1961 | Osborne |
| 3,026,579 | A | * | 3/1962 | Carter |
| 3,027,823 | A | * | 4/1962 | Martin |
| 3,421,259 | A | * | 1/1969 | Egan, Jr. |
| 3,584,413 | A | | 6/1971 | Abrami |
| 4,355,676 | A | | 10/1982 | Lee |
| 4,724,634 | A | | 2/1988 | Blum |
| 4,899,491 | A | * | 2/1990 | Okumoto |
| 5,461,828 | A | | 10/1995 | Jordal |
| 5,537,779 | A | * | 7/1996 | Jackson |
| 5,737,874 | A | | 4/1998 | Sipos et al. |
| 6,164,363 | A | * | 12/2000 | Colson et al. |

* cited by examiner

*Primary Examiner*—Blair M. Johnson
(74) *Attorney, Agent, or Firm*—Woodard, Emhardt, Naughton Moriarty & McNett

(57) ABSTRACT

A system for mounting a solar screen to an awning window of an enclosure is provided that allows the awning window to be opened and closed with the solar screen mounted on the exterior of the awning window.

23 Claims, 4 Drawing Sheets

SOLAR SCREEN MOUNTING FOR AN AWNING WINDOW

FIELD OF THE INVENTION

The present invention relates generally to solar screens for windows, and more particularly to a solar screen mounting system for an awning window.

BACKGROUND

Sun rooms, enclosed porches, mobile homes, RV's, campers and homes and other types of enclosures often employ walls and doors which have windows to allow entry of natural sunlight and visualization of the exterior of the enclosure. One disadvantage in using windows, particularly if substantially all the door or wall are is occupied by such windows, is that direct sunlight can heat the room and can also impinge on the glass to cause the glass to become very hot. The heat from the glass radiates into the room, and along with the direct sunlight, can make the room very hot and increase the energy required to air condition the enclosure to the desired temperature.

One type of window commonly employed in doors and walls of such enclosures is referred to as an awning window, such as that described in U.S. Pat. No. 5,461,828 to Jordal, which is incorporated herein by reference in its entirety. An awning window has at least an upper pane in the window frame and a lower pane in the frame below the upper pane. Each pane is pivotally attached to the window frame at the upper end of the pane, and is opened by pivoting the bottom end of each pane exteriorly of the structure about its upper end.

While the prior art has employed interior shades and shutters to block sunlight from the interior of an enclosure having awning windows, these types of devices still allow the sunlight to directly impinge on the glass. Thus the heat absorbed by the glass will radiate into the interior of the enclosure. The use of exterior solar screens and other exterior coverings have heretofore been impracticable with awning windows since the exterior covering obstructs opening of the awning window.

U.S. Pat. No. 2,755,524 to Honer shows an exterior cover of wire mesh for a louver assembly. The wire mesh extends exteriorly from the enclosure a relatively large distance in order to provide room for opening and closing of the louvers. However, such an exterior covering can be unsightly, difficult to install, and intrusive into the exterior space around the louver. Further, such exterior covering are not practically employed with enclosures having several louvers in side-by-side relation since there is little or no wall structure between the louvers in which to mount the exterior covers.

What is therefore needed is a system for mounting a solar screen or other shading device on the exterior of an awning window. The system should be easily and readily installed on the exterior of the awning window while minimizing intrusion into and obstruction of the exterior space around the window. The system should be readily adapted for attachment and removal of solar screens from existing or new awning window installations, whether the awning window is isolated in a wall or door of the enclosure, or is one of series of side-by-side awning windows. Further, the system should allow opening and closing of the awning window with the solar screen mounted thereon.

SUMMARY OF THE INVENTION

According to one aspect of the invention, there is provided a solar screen for an awning window. The solar screen is pivotally mounted to the bottom portion of at least one pane of the awning window.

According to another aspect of the invention, there is provided a solar screen mounted on the exterior of an awning window that moves exteriorly with respect to the enclosure as the awning window is opened and interiorly with respect to the enclosure as the awning window is closed.

According to a further aspect of the invention, there is provided a solar screen mounted on the exterior of an awning window that remains generally parallel with the wall of the enclosure as the awning window is opened and closed.

These and other aspects, forms, advantages, features and embodiments of the present invention will also be apparent from the following description of the illustrated embodiments

DESCRIPTION OF THE ILLUSTRATED EMBODIMENTS

Figure 1:
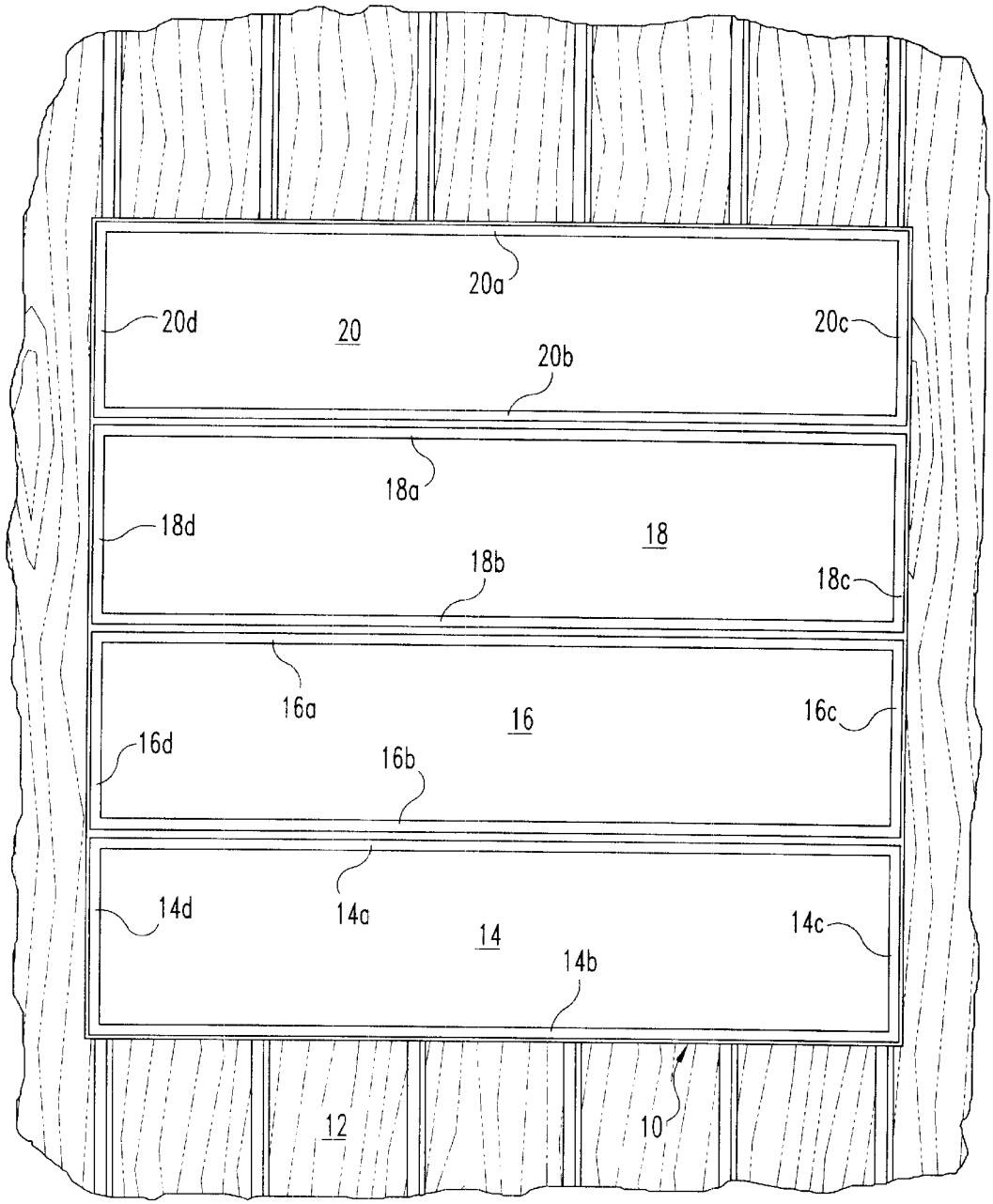
FIG. 1 is a front elevational view of the exterior of an awning window.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any such alterations and further modifications in the illustrated device, and any such further applications of the principles of the invention as illustrated herein are contemplated as would normally occur to one skilled in the art to which the invention relates.

Figure 2:
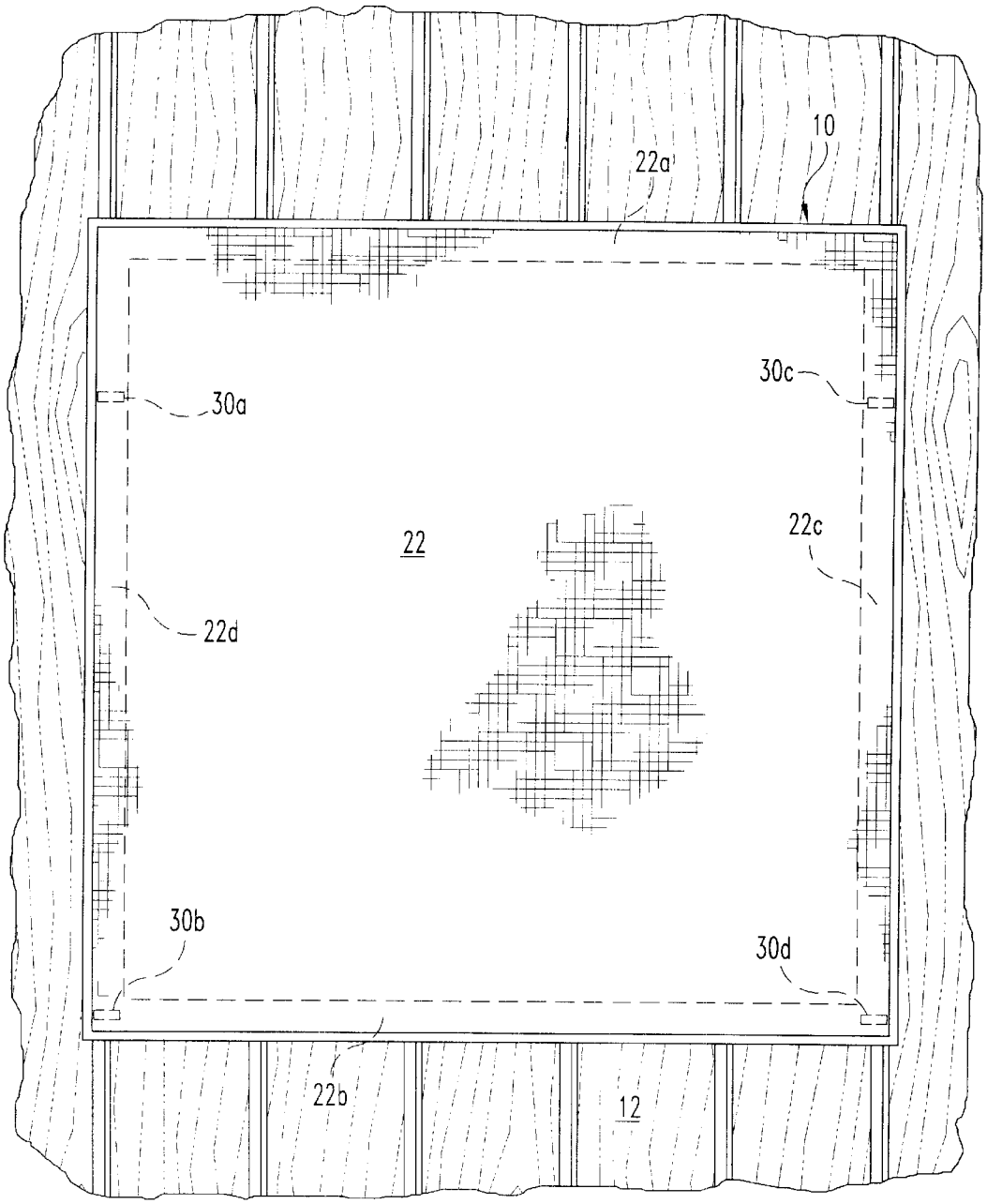
FIG. 2 is a front elevational view of a solar screen mounted on the exterior of the awning window of FIG. 1.

Referring now to FIG. 1, there is shown an awning window 10 mounted on the wall 12 of an enclosure. Awning windows are known in the art and details regarding their design, operation and mounting in the wall of an enclosure will not be described in detail herein. As shown in FIG. 2, awning window 10 is substantially covered by a solar screen 22 mounted exteriorly thereof in order to shade awning window 10 and the interior of the enclosure from direct sunlight. The present invention provides a system for pivotally mounting solar screen 22 to a lower portion of at least one pane so awning window 10 can be opened and closed with solar screen 22 coupled thereto.

Solar screen 22 can be made from solar screen material known in the art that reflects, absorbs and/or dissipates sunlight while allowing visualization inside out. It should be further understood that the present invention contemplates solar screen 22 can be made from any material that is capable of shading, blocking, or reducing the sunlight directed through awning window 10.

It is contemplated that wall 12 of the enclosure in which awning window 10 is mounted could be a door or the exterior wall of an enclosure. It is further contemplated that the enclosure could be any type of structure, such as a dwelling, a sun room, a mobile home, an enclosed porch, a RV, a commercial building, or an industrial building.

Referring back to FIG. 1, awning window 10 includes a lower pane 14, an upper pane 20, a first intermediate pane 16 adjacent to and above lower pane 14 and a second intermediate pane adjacent to and below upper pane 20. Lower pane 14 can include an upper frame member 14*a* along an upper portion thereof, a lower frame member 14*b* along a lower portion thereof, and side frame members 14*c*, 14*d* along the sides thereof extending between upper and lower frame members 14*a*, 14*b*. Upper pane 20 can include an upper frame member 20*a* along an upper portion thereof, a lower frame member 20*b* along a lower portion thereof, and side frame members 20*c*, 20*d* along the sides thereof extending between upper and lower frame members 20*a*, 20*b*. First intermediate pane 16 can include an upper frame member 16*a* along an upper portion thereof, a lower frame member 16*b* along a lower portion thereof, and side frame members 16*c*, 16*d* along the sides thereof extending between upper and lower frame members 16*a*, 16*b*. Second intermediate pane 18 can include an upper frame member 18*a* along an upper portion thereof, a lower frame member 18*b* along a lower portion thereof, and side frame members 18*c*, 18*d* along the sides thereof extending between upper and lower frame members 18*a*, 18*b*.

It should be understood, however, that the present invention contemplates awning window 10 could be provided with any number of panes, including a single pane, and that the one or more panes need not be encompassed by or include frame members.

Figure 3:
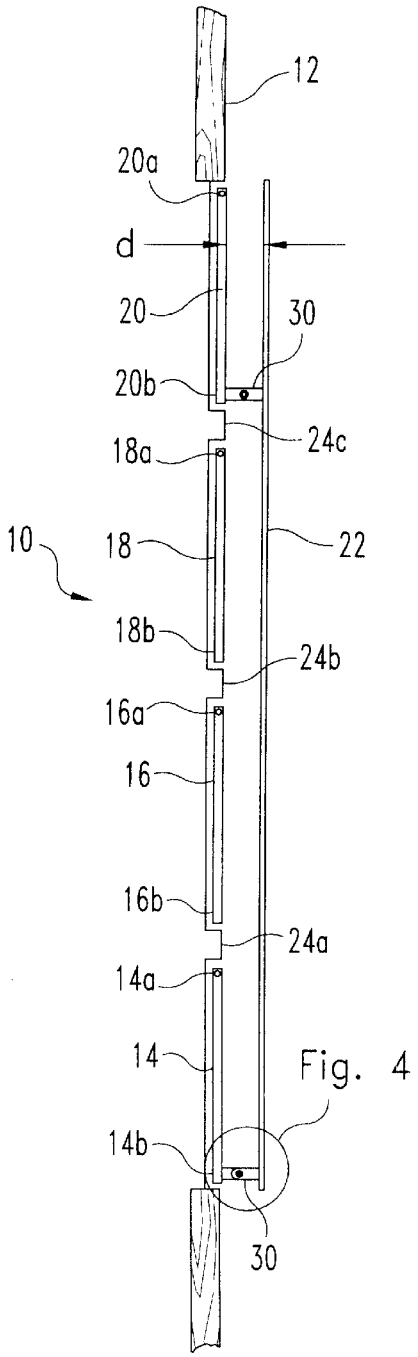
FIG. 3 is a side elevational view of the awning window and solar screen of FIG. 2 in the closed position.
Figure 7:
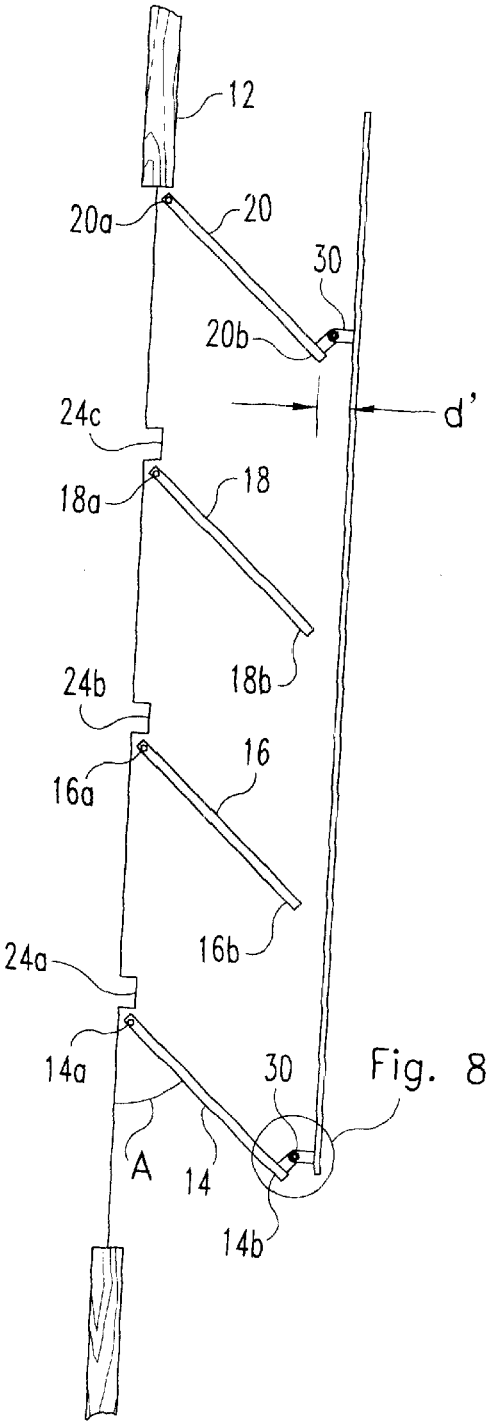
FIG. 7 is a side elevational view of the awning window and solar screen of FIG. 2 in the open position.

Each of panes 14, 16, 18 and 20 can be opened as shown in FIG. 7 and closed as shown in FIG. 3 by a crank mechanism (not shown) which pivots the lower portion of the pane exteriorly about its upper portion. When panes 14, 16, 18, 20 are opened, each pane forms the same angle A with wall 12 of the enclosure. Angle A can vary from 0 degrees to 90 degrees based on how far panes 14, 16, 18 and 20 are opened.

As shown in FIG. 2, solar screen 22 can include perimeter support members to support the solar screen material so it remains taut on the exterior of window 10. Perimeter supports members include upper support 22*a* extending along the upper portion of upper pane 20, lower support 22*b* extending along the lower portion of lower pane 14, and side supports 22*c*, 22*d* extending between upper support 22*a* and lower support 22*b*.

Referring now to FIG. 3, there is shown awning window 10 in a closed position with solar screen 22 mounted exteriorly thereto. Solar screen 22 is mounted to awning window 10 via at least one coupler 30. In the illustrated embodiment, there are provided four couplers 30*a*, 30*b*, 30*c*, and 30*d* located at various locations with respect to awning window 10 and solar screen 22 as shown in FIG. 2. Coupler 30*a* is attached to the lower portion of upper pane 20 and to side support 22*d* of solar screen 22. Coupler 30*b* is attached to the lower portion of lower pane 14 and one of the side support 22*d* or bottom support 22*b* of solar screen 22. Coupler 30*c* is attached to the lower portion of upper pane 20 and to side support 22*c* of solar screen 22. Coupler 30*d* is attached to the lower portion of lower pane 14 and one of the side support 22*c* or bottom support 22*b* of solar screen 22.

Couplers 30 pivot so that solar screen 22 remains parallel with wall 12 of enclosure 10. Since couplers 30 are mounted on the lower portions of panes 14 and 20, solar screen 22 travels toward the exterior of enclosure 10 along with the lower portions of panes 14 and 20 as panes 14 and 20 are opened. Screen 22 further travels toward the interior of enclosure 10 along with the lower portions of panes 14 and 20 as the panes are closed.

As shown in FIG. 3, each of the couplers 30*a*, 30*b*, 30*c*, 30*d* spaces solar screen 22 a distance d from the closed awning window 10. Solar screen 22 thus defines a plane that is parallel to a plane defined by wall 12 and by panes 14, 16, 18 and 20 when awning window 10 is closed. It is contemplated that distance d can be selected to minimize intrusion of solar screen 22 into the exterior space surrounding awning window 10. When awning window 10 is opened as shown in FIG. 7, each of the panes 14, 16, 18 and 20 form angle A with the wall 12. When panes 14, 20 are opened, solar screen 22 is spaced a second distance d' from panes 14, 16, 18 and 20 that is less than distance d as a result of the pivoting of couplers 30.

Figure 4:
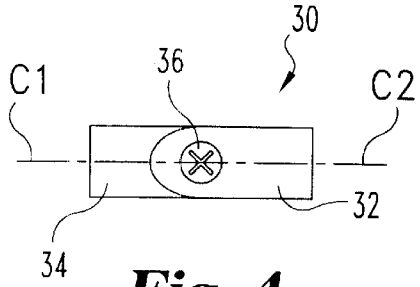
FIG. 4 is an enlarged detail view of a coupler in FIG. 3 used to mount the solar screen to the awning window when the awning window is closed.
Figure 5:
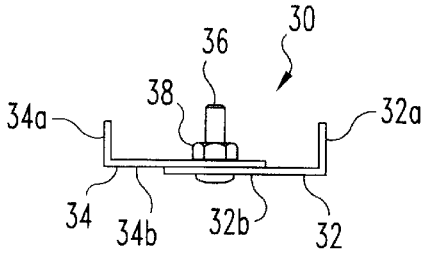
FIG. 5 is a top plan view of the coupler of FIG. 4.
Figure 6:
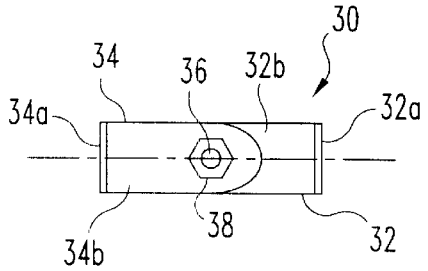
FIG. 6 is a side elevational view of the coupler looking in the direction opposite of the view of FIG. 4.

Referring now to FIGS. 4–6, further details regarding coupler 30 will be provided. Coupler 30 includes a screen coupling member 32 mountable to the interior side of solar screen 22 and a window coupling member 34 mountable to the exterior of the lower portion of any one of the panes 14, 16, 18 or 20 of awning window 10. Coupling members 32, 34 are pivotally secured to one another by a pin 36. Pin 36 can be a bolt, cotter pin, rivet or any other fastener that allows coupling members 32, 34 to pivot with respect to one another as awning window 10 is opened and closed. Preferably, pin 36 is configured to allow coupling members 32, 34 to be easily disassembled from one another so that solar screen 22 can be removed when not needed or wanted, or if it requires replacement.

Screen coupling member 32 includes a base member 32*a* and a window connector 32*b* extending from base member 32*a* and screen 22 towards the interior of the enclosure when mounted to solar screen 22 as shown in FIG. 3. Window connector 32*b* can be formed as a unit with base member 32*a*. It is also contemplated that window connector 32*b* can be welded, bolted, riveted, or otherwise permanently or removably attached to base member 32*a*. Base member 32*a* can be welded, glued, bolted, screwed, riveted or otherwise permanently or removably attached to the one of the support members 22*a*, 22*b*, 22*c*, 22*d* of screen 22. It is also contemplated that base member 32*a* can be attached directly to the screen material. In another form, base member 32*a* is not provided and screen connector 32*b* is attached directly to the solar screen or screen support member.

Window coupling member 34 includes a base member 34*a* and a screen connector 34*b* extending from base member 34*a* and window 10 towards the exterior of the enclosure when mounted to window 10 as shown in FIG. 3. Screen connector 34*b* can be formed as a unit with base member 34*a*. It is also contemplated that screen connector 34*b* can be welded, bolted, riveted, or otherwise permanently or removably attached to base member 34*a*. Base member 34*a* can be welded, glued, bolted, screwed, riveted or otherwise permanently or removably attached to the lower portion of one of the panes 14, 16, 18 or 20. It is also contemplated that base member 34*a* can be attached directly to the glass of the pane or to the lower frame member along the bottom of the pane.

In another form, base member 34*a* is not provided and screen connector 34*b* is attached directly to the pane.

Figure 8:
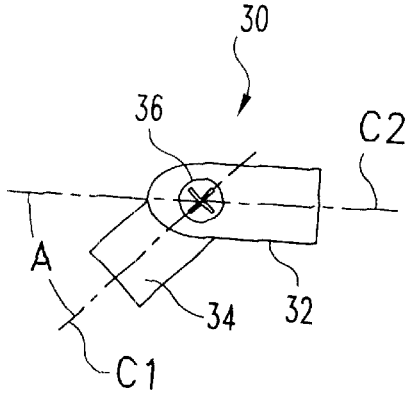
FIG. 8 is an enlarged detail view of the coupler used to mount the solar screen to the awning window when the awning window is opened.

FIGS. 3 and 7 further illustrate that solar screen 22 remains parallel with wall 12 of the enclosure as awning window 10 is moved between its open and closed positions. In FIG. 8, coupler 30 is shown in further detail with its window open orientation. Window coupling member 34 has a central axis C1 that is oriented transversely to the pane on which it is mounted. In the illustrated embodiment, this transverse orientation between central axis C1 and the pane is perpendicular, although it should be understood that non-perpendicular orientations are contemplated.

Screen coupling member 32 has a central axis C2 oriented generally transversely to the plane defined by solar screen 22. In the illustrated embodiment, this transverse orientation between C2 and the solar screen is perpendicular, although it should be understood that non-perpendicular orientations are contemplated. The orientation of central axis C1 and the pane to which it is attached and the orientation of central axis C2 and solar screen 22 and then solar screen to which it is attached is maintained throughout opening and closing of awning window 10. As shown in FIG. 4, with awning window 10 closed axes C1 and C2 are co-linear or parallel to one another. As shown in FIG. 8, as awning window 10 is opened, axes C1 and C2 are not generally co-linear or parallel, but rather are oriented to form angle A which corresponds to angle A formed between each of the open window panes and wall 12 of the enclosure. This angle A varies based on the how far the window panes are opened. The two point attachment of solar screen 22 to both an upper pane and a lower pane prevents limits the range coupler 30 pivots between co-linear or parallel arrangement between axes C1 and C2 and the non-parallel or non co-linear arrangement between axes C1 and C2 as described above.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A shading system for an awning window mounted in a wall of an enclosure, the enclosure defining an interior and an exterior, the awning window including at least an upper pane and a lower pane positioned below the upper pane, wherein each of the upper and lower panes includes a lower portion, each of the lower portions simultaneously pivoting toward the exterior of the enclosure about an opposite upper portion when the awning window is opened, the shading system comprising:

a solar screen substantially covering the exterior side of the awning window, wherein said solar screen is pivotally attached to the lower portion of each of the lower pane and the upper pane.

2. The system of claim 1, wherein said solar screen is pivotally attached to the exterior side of the lower portion of the upper pane and the lower portion of the lower pane.

3. The system of claim 1, further comprising at least two couplers for pivotally attaching said solar screen to the lower portions of each of the lower pane and the upper pane, said couplers spacing said solar screen a distance from the exterior side of the awning window.

4. The system of claim 1, wherein said solar screen is pivotally attached to a lower frame member of the upper pane and is also pivotally attached to a lower frame member of the lower pane.

5. The system of claim 1, wherein:

said solar screen pivotally attached to the upper pane at first and second locations along the lower portion of the upper pane; and said solar screen is pivotally attached to the lower pane at first and second locations along the lower portion of the lower pane.

6. The system of claim 1, further comprising:

a first window coupling member secured to the lower portion of the upper pane;

a first screen coupling member secured to said solar screen, wherein said first window coupling member and said first screen coupling member are pivotally coupled to one another;

a second window coupling member secured to the lower portion of the lower pane; and a second screen coupling member secured to said solar screen, wherein said second window coupling member and said second screen coupling member are pivotally coupled to one another.

7. The system of claim 6, wherein:

said first and second window coupling members each include a screen connector extending toward the exterior from a respective one of said upper and lower panes;

said first and second screen coupling members each include a window connector extending toward the interior from said solar screen, each of said screen connectors being pivotally coupled to a corresponding one of said window connectors.

8. The system of claim 7, wherein said screen connectors and said window connectors are sized to space said solar screen a distance from the awning window.

9. The system of claim 6, wherein:

each of said window coupling members has a first central axis extending therethrough transversely to a plane defined by the pane to which it is attached;

each of said screen coupling members has a second central axis extending therethrough transversely to a plane defined by said solar screen, said screen coupling members being coupled to a respective one of said window coupling members along said first and second central axes, wherein:

when the awning window is closed said first and second central axes are co-linear; and when the awning window is open said first and second central axes form an angle with respect to one another that is the same as an angle the upper and lower panes form with the wall of the enclosure.

10. The system of claim 6, wherein each of said screen coupling members is removably coupled to a corresponding one of said window coupling members.

11. The system of claim 1, wherein said solar screen provides substantially the same shading of sunlight from the interior of enclosure whether the awning window is opened or closed.

12. A shading system for an awning window mounted in a wall of an enclosure, the enclosure defining an interior and an exterior, the awning window including an upper pane and a lower pane positioned below the upper pane, wherein the upper and lower panes each include a lower portion, each of the lower portions simultaneously pivoting toward the exterior of the enclosure about an opposite upper portion when the awning window is opened, the shading system comprising:

a solar screen substantially covering the exterior side of the awning window;

a first window coupling member secured to the lower portion of said upper pane;

a first screen coupling member secured to said screen, wherein said first window coupling member and said first screen coupling member are pivotally coupled to one another;

a second window coupling member secured to the lower portion of the lower pane; and a second screen coupling member secured to said screen, wherein said second window coupling member and said second screen coupling member are pivotally coupled to one another.

13. The system of claim 12, wherein:

said first and second window coupling members each include a screen connector extending toward the exterior from a respective one of said upper and lower panes;

said first and second screen coupling members each include a window connector extending toward the interior said solar screen, each of said screen connectors being pivotally coupled to a corresponding of said window connectors.

14. The system of claim 12, wherein each of said window coupling members is removably coupled to a corresponding one of said screen coupling members.

15. The system of claim 12, wherein said solar screen is spaced a distance from the awning window.

16. The system of claim 12, wherein:

said solar screen moves toward the exterior simultaneously with opening of the awning window; and said solar screen moves toward the interior, simultaneously with the closing of the awning window.

17. The system of claim 12, wherein said solar screen provides substantially the same shading of sunlight from the interior of enclosure whether the awning window is opened or closed.

18. A shading system for an awning window mounted in a wall of an enclosure, the enclosure defining an interior and an exterior, the shading system comprising:

solar screen substantially covering the exterior side of the awning window, said solar screen being attached to the awning window such that said solar screen is parallel with the wall of the enclosure when the awning window is closed, wherein:

said solar screen moves toward the interior simultaneously with the opening of the awning window and remains parallel with the wall of the enclosure; and said solar screen moves toward the interior simultaneously with the closing of the awning window and remains parallel with the wall of the enclosure.

19. The system of claim 16, wherein said solar screen is spaced a distance from the awning window during opening and closing of the awning window.

20. The system of claim 16, wherein said solar screen is pivotally attached to the exterior of the awning window.

21. The system of claim 18, further comprising:

a first coupler secured to said solar screen and a first portion of the awning window; and a second coupler secured to said solar screen and a second portion of the awning window below the first portion, wherein said first coupler and said second coupler are each pivoted during opening and closing of the awning window.

22. The system of claim 18, wherein:

when the awning window is closed said solar screen is spaced a first distance from the awning window; and when the awning window is opened said solar screen is spaced a second distance from the awning window, said second distance being less than said first distance.

23. The system of claim 18, wherein said solar screen provides substantially the same shading of sunlight from the interior of enclosure whether the awning window is opened or closed.

* * * * *